US009257786B2

(12) United States Patent
Chen et al.

(10) Patent No.: US 9,257,786 B2
(45) Date of Patent: Feb. 9, 2016

(54) ELECTRICAL CONNECTOR HAVING ELASTIC ELEMENT

(71) Applicant: FOXCONN INTERCONNECT TECHNOLOGY LIMITED, Grand Cayman (KY)

(72) Inventors: Ding-Cherng Chen, New Taipei (TW); Chien-Jen Ting, New Taipei (TW)

(73) Assignee: FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 14/594,054

(22) Filed: Jan. 9, 2015

(65) Prior Publication Data

US 2015/0194766 A1 Jul. 9, 2015

(30) Foreign Application Priority Data

Jan. 9, 2014 (CN) ..... 2014 2 0012410

(51) Int. Cl.
*H01R 13/627* (2006.01)
*H01R 12/72* (2011.01)
*H01R 24/60* (2011.01)

(52) U.S. Cl.
CPC ..... *H01R 13/6275* (2013.01); *H01R 12/722* (2013.01); *H01R 24/60* (2013.01)

(58) Field of Classification Search
CPC .. H01R 13/6275; H01R 24/60; H01R 12/722; H01R 13/631; H01R 13/193; H01R 13/641
USPC ..... 439/355
See application file for complete search history.

(56) References Cited

U.S. PATENT DOCUMENTS

| | | | | |
|---|---|---|---|---|
| 7,425,157 | B1 * | 9/2008 | Hung | G06K 19/07741 439/630 |
| 7,862,382 | B2 * | 1/2011 | Nishio | G06K 7/0021 439/159 |
| 8,092,244 | B1 * | 1/2012 | Lan | H01R 13/506 439/345 |
| 2011/0217878 | A1 * | 9/2011 | Liu | H01R 24/00 439/630 |
| 2011/0237101 | A1 * | 9/2011 | Yang | H01R 12/737 439/153 |
| 2012/0276780 | A1 * | 11/2012 | Hu | H01R 12/714 439/630 |

FOREIGN PATENT DOCUMENTS

CN 201181774 1/2009

* cited by examiner

*Primary Examiner* — Jean F Duverne
(74) *Attorney, Agent, or Firm* — Wei Te Chung; Ming Chieh Chang

(57) ABSTRACT

An electrical connector, for mating with a mating plug, includes an insulative housing (1), a number of contacts (2) received in the insulative housing (1), a shell (3) mounted to the insulative housing (1) and an elastic element (4) mounted to the receiving space (100). The insulative housing includes a top wall (12), a lower wall (13), two side walls (14) and a receiving space surrounded by the top wall, the lower wall and the two side walls. The shell (3) comprises a pair of elastic arms (342). The elastic element (4) resists against the elastic arm (342) upon inserting a mating plug to move the pair of least arms outward.

13 Claims, 5 Drawing Sheets

ELECTRICAL CONNECTOR HAVING ELASTIC ELEMENT

BACKGROUND OF THE INVENTION

1. Field of the Invention

The present invention relates generally to an electrical connector, and more particularly to an electrical connector assembly having an elastic element.

2. Description of Related Arts

China Patent No. 201181774, issued on Jan. 14, 2009, discloses an electrical connector comprising an insulative housing and a metal shell enclosing the insulative housing. The metal shell defines a receiving space for receiving a mating plug. The metal shell comprises a pair of side walls surrounding the receiving space. An elastic arm extends from each of the side walls into the receiving space for cooperating with an inserted plug.

An electrical connector having an elastic element to cooperate with above mentioned side wall elastic arms is desired.

SUMMARY OF THE INVENTION

Accordingly, an object of the present invention is to provide an electrical connector having an elastic element.

To achieve the above object, an electrical connector for mating with a mating plug includes an insulative housing, a plurality of contacts received in the insulative housing, a shell mounted to the insulative housing, and an elastic element mounted to the receiving space. The insulative housing includes a top wall, a lower wall, two side walls, and a receiving space surrounded by the top, lower, and side walls. The shell comprises a pair of elastic arms. The elastic element resists against the elastic arm upon inserting a mating plug to move the pair of least arms outward.

Other objects, advantages and novel features of the invention will become more apparent from the following detailed description when taken in conjunction with the accompanying drawings.

DETAILED DESCRIPTION OF THE PREFERRED EMBODIMENT

Figure 1:
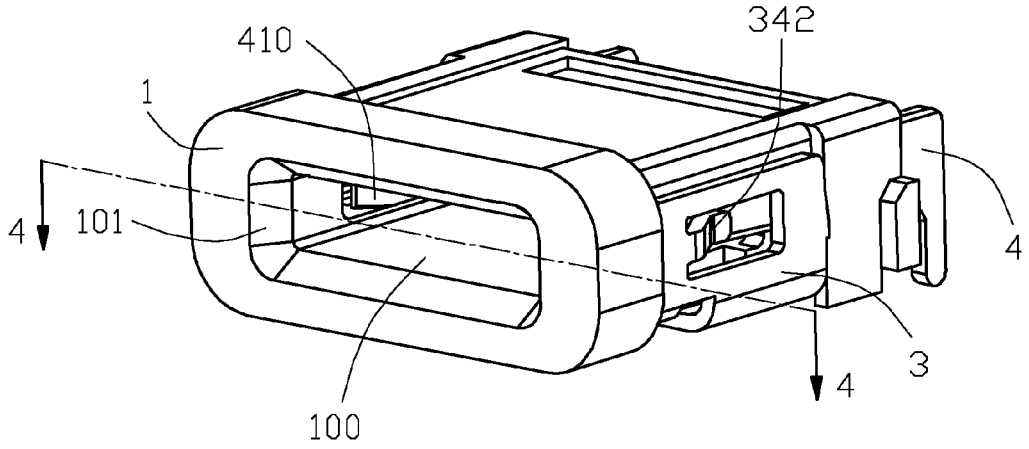
FIG. 1 is a perspective, assembled view of an electrical connector of the present invention.

Reference will now be made in detail to the preferred embodiment of the present invention.

Referring to FIGS. 1 to 4, an electrical connector 100 of the present invention mating with a mating plug (not labelled) comprises an insulative housing 1, a plurality of contacts 2 received in the insulative housing 1, a shell 3 mounted to the insulative housing 1, a pair of elastic or latch elements 4 mounted to a pair of side walls of the insulative housing 1, and an affixed element 5 mounted to a rear of the insulative housing 1.

Figure 2:
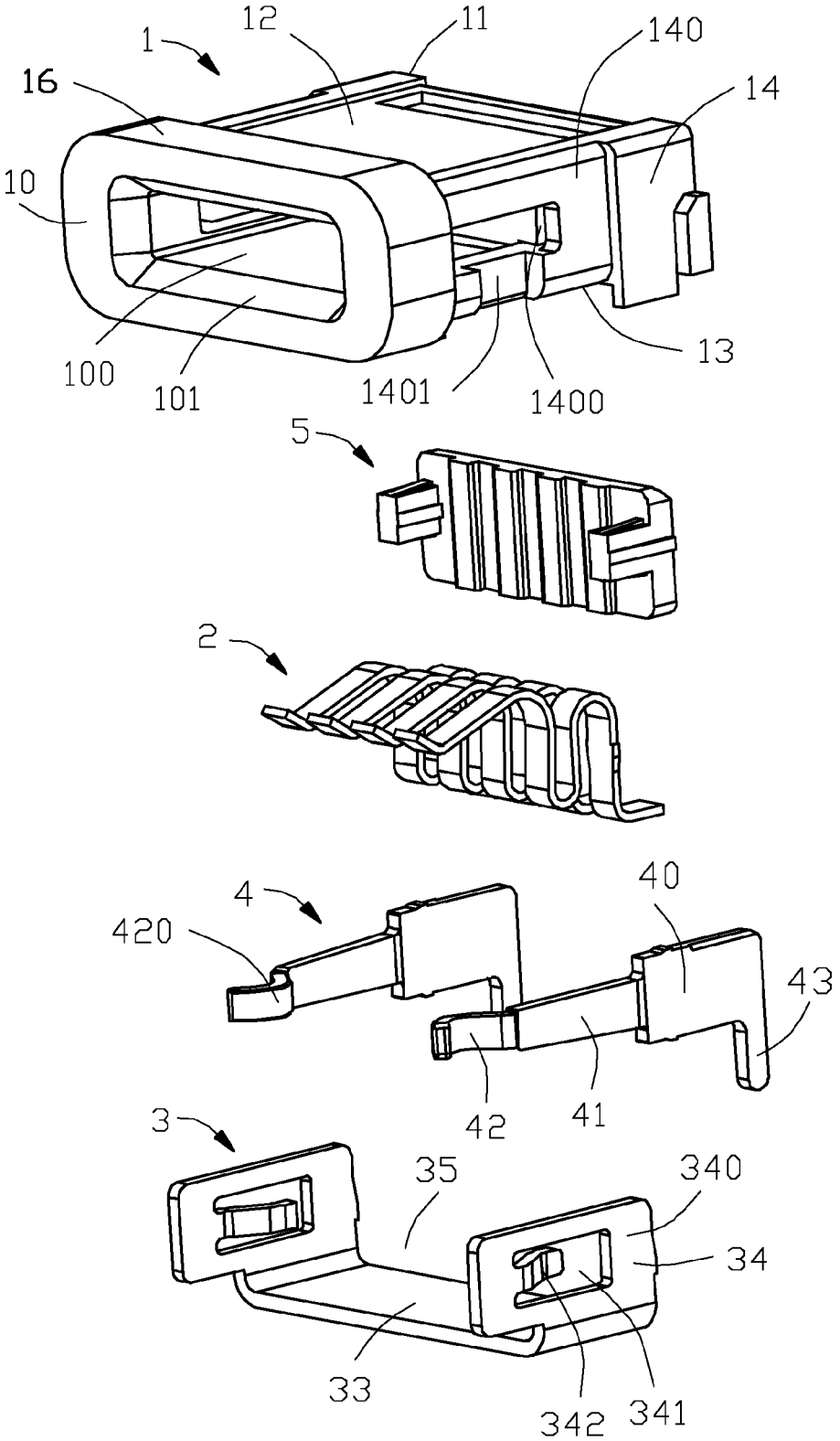
FIG. 2 is a perspective, exploded view of the electrical connector shown in FIG. 1.

Referring to FIG. 2, the insulative housing 1 comprises a top wall 12, a lower wall 13, two side walls 14, a receiving space 100 surrounded by the top wall 12, the lower wall 13 and the two side walls 14, a flange 16 extending outwardly from a front end 10 of the four walls 12, 13, 14 for enhancing the strength of the front end 10, and a guiding portion 101 extending rearwardly from the front end 10 for guiding the mating plug. The two side walls 14 define a sunken area 140, a through groove 1400 communicating with the sunken area 140 and the receiving space 100, and a containing groove 1401 located under and communicating with the through groove 1400.

The shell 3 comprises a lower shell wall 33, two side shell walls 34 enclosing the lower shell 13 and the two side walls 14 of the insulative housing 1, and a containing space 35 receiving the insulative housing 1. The two side shell walls 34 comprise a base section 340, a hole 341 extending through each side shell wall 34, and an elastic arm 342 extending from the base section 340 to the hole 340 and the containing space 35, respectively. The two side shell walls 34 are mounted to the two side walls 14 and located in the sunken area 140. The lower shell wall 33 are mounted to the lower wall 13 of the insulative housing 1.

Figure 3:
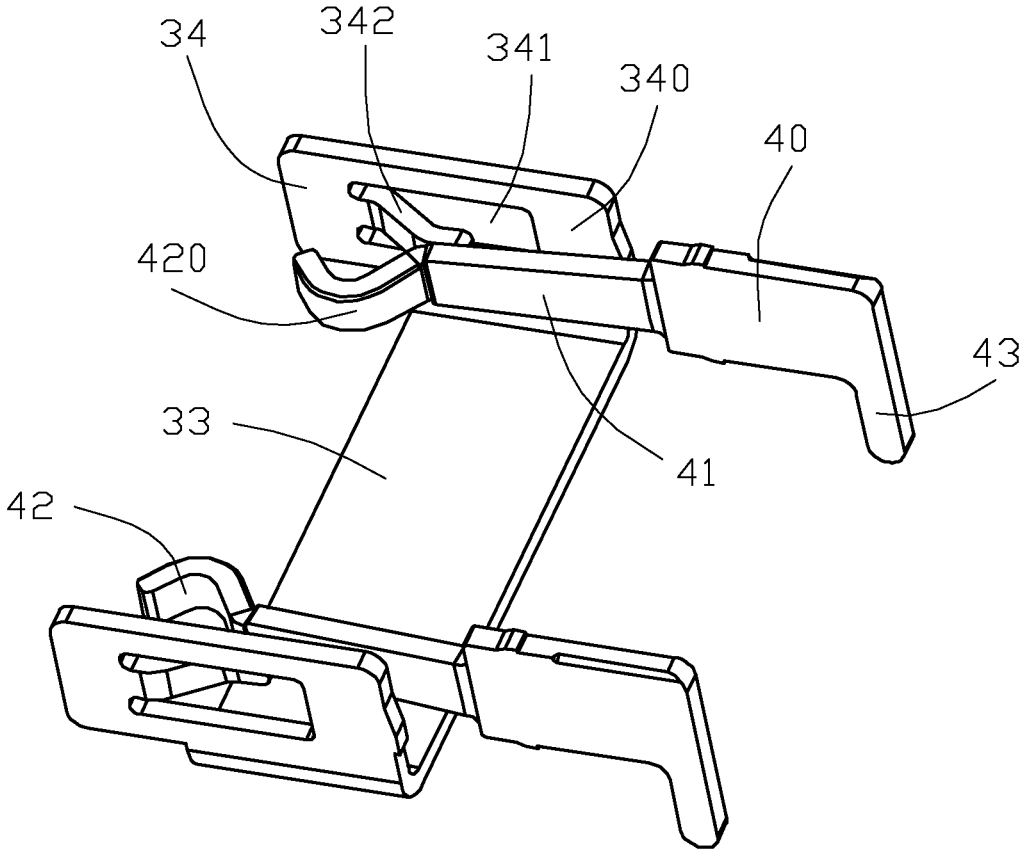
FIG. 3 is a perspective, assembled view of the electrical connector of the electrical connector shown in FIG. 1.

Referring to FIGS. 2 and 3, the elastic elements 4 are each inverted L-shaped and arranged at two opposite sides. Each elastic element 4 comprises a main portion 40, a main arm 41 extending from an end of the main portion 40, a bending portion 42 bent from a rear end of the main arm 41, and a grounding portion 43 extending downwardly from another end of the main portion 40. The height of the main portion 40 is greater than the height of the bending portion 42. The bending portion 42 of one of the elastic elements 4 comprises a mating portion 420 projecting toward the other elastic element 4. The grounding portion 43 is to be soldered to a printed circuit board. The elastic element 4 resists against the elastic arm 342 upon inserting a mating plug to move the pair of least arms outward.

Figure 4:
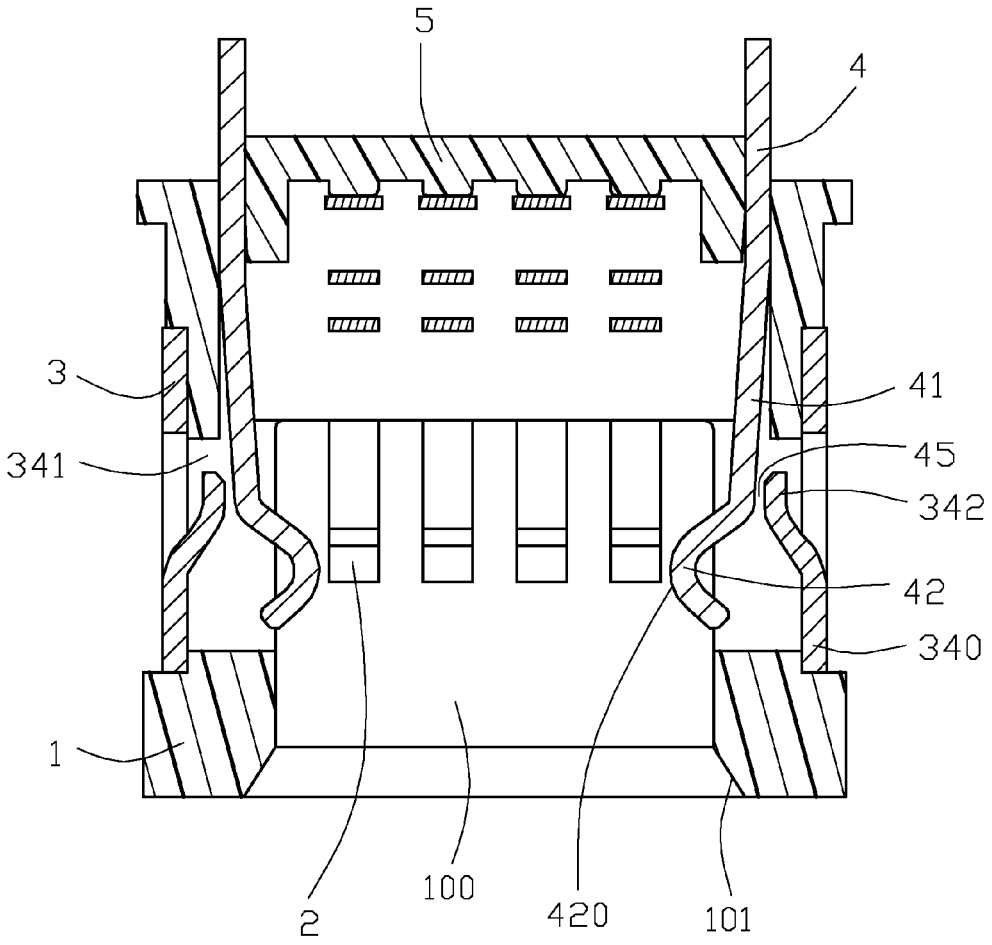
FIG. 4 is a cross-sectional view of the electrical connector shown in FIG. 1 along line 4-4.
Figure 5:
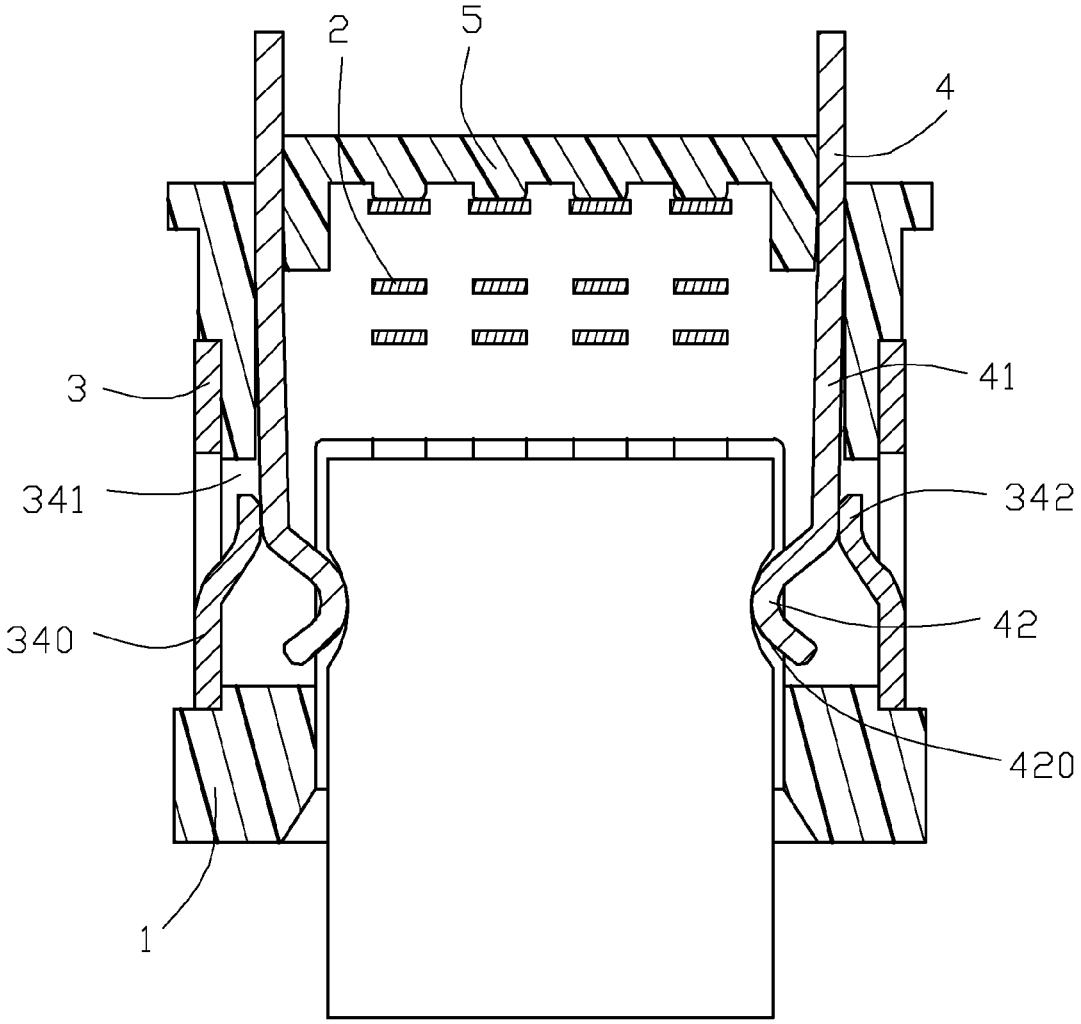
FIG. 5 is a cross-sectional view of the electrical connector when a mating plug is inserted into the electrical connector shown in FIG. 1 along line 4-4.

Referring to FIGS. 4 and 5, in assembly, the shell 3 is bottom mounted to the sunken area 140. The elastic element 4 is front mounted to the receiving space 100. The affixed element 5 is mounted to the area between the pair of elastic elements 4 from front to back for increasing the fixing strength and rigidity of the elastic elements 4. There is a gap 45 defined between the elastic arm 342 and the main arm 41. While the mating plug is inserted into the receiving space 100, the mating portion 420 resists against the mating plug with a distortion, and then the main arm 41 resists against the elastic arm 342 with another distortion, so that an elastic force is released, potential damage to the main arm 41 or the elastic arm 342 is reduced and the mating plug can be inserted or extracted steadily. In brief, the elastic arm 342 may be essentially deemed as a metallic resilient structure which is located between the shell 3 and the elastic element 4 and is activated and deformed to simultaneously connect to both the shell 3 and the element 4 when the mating plug is received in the receiving space 100 while is not when no mating plug is received therein. In this embodiment such a resilient structure is unitarily formed upon the shell 3. Understandably, such a resilient structure may be unitarily formed on the elastic arm instead.

What is claimed is:

1. An electrical connector for mating with a mating plug, comprising:

an insulative housing comprising a top wall, a lower wall, two side walls, and a receiving space surrounded by the top wall, the lower wall, and the two side walls;

a plurality of contacts received in the insulative housing;

a shell mounted to the insulative housing and comprising a pair of elastic arms; and an elastic element mounted to the receiving space, the elastic element resisting against the elastic arm upon inserting a mating plug to deflect the pair of least arms outward; wherein the elastic element comprises a main arm for engaging with the elastic arm elastically; wherein the elastic element comprises a main portion, the elastic arm extending from an end of the main portion, a bending portion bent from a rear end of the main arm and a grounding portion extending downwardly from another end of the main portion; wherein there are a pair of said elastic elements arranged at two opposite sides of the insulative housing, respectively, the elastic element being inverted L-shaped; wherein the bending portion of one of the elastic elements comprises a mating portion projecting toward another elastic element for mating with the mating plug; wherein the bending portion extends into the receiving space, the extending direction of the elastic arm and the bending portion are opposite along the inserting direction.

2. The electrical connector as claimed in claim 1, wherein the shell comprises two side shell walls enclosing the two side walls and a lower shell wall enclosing the lower wall, and the elastic arms are respectively formed on the two side shell walls.

3. The electrical connector as claimed in claim 2, wherein each side shell wall comprises a base section and a through hole, the shell defines a containing space between the two side shell walls, and the elastic arm extends from the base section to the containing space.

4. The electrical connector as claimed in claim 2, wherein the two side walls define a sunken area, a through groove communicating with the sunken area and the receiving space, and the two side shell walls of the shell are mounted to the sunken area.

5. The electrical connector as claimed in claim 1, wherein the insulative housing comprises a flange extending outwardly from a front end of the top wall, the lower wall and two side walls for enhancing the strength of the front end, and a guiding portion extending rearwardly from the front end and guiding the mating plug.

6. The electrical connector as claimed in claim 1, further comprising an affixed element mounted to a rear of the insulative housing.

7. An electrical connector assembly comprising:

an insulative housing defining a receiving space therein;

a plurality of contacts disposed in the housing with corresponding deflectable contacting sections extending into the receiving space;

a metallic shell enclosing at least partially the housing; and a pair of latch elements disposed on the housing around two opposite lateral sides in a lateral direction, each of said latch elements including a deflectable arm extending into the receiving space along a front-to-back direction, which is perpendicular to said lateral direction, with a bulged mating portion around a front end thereof; and a pair of resilient structures being respectively located between the pair of latch elements and the shell and deformable in said lateral direction;

wherein said resilient structure is activated to simultaneously contact both the deflectable arm of the corresponding latch element and the shell when a plug connector is received within the receiving space while is not when no plug connector is received within the receiving space; wherein both said latch element and said resilient structure are metallic so as to form a conductive path from the latch element to the shell via said resilient structure when the resilient structure is activated and deformed.

8. The electrical connector assembly as claimed in claim 7, wherein the resilient structure is unitarily formed on the shell.

9. The electrical connector assembly as claimed in claim 7, wherein said plug connector forms a pair of notches in two opposite lateral sides to receive the bulged mating portions of the corresponding latch elements therein for locking, respectively.

10. The electrical connector assembly as claimed in claim 7, wherein said latch element further includes a leg for mounting to a printed circuit board.

11. The electrical connector assembly as claimed in claim 7, wherein the housing forms a pair of openings through which the corresponding resilient structures extend, respectively.

12. An electrical connector assembly comprising:

a first connector including:

an insulative housing with a receiving space thereabouts;

a plurality of contacts disposed in the housing with contacting sections exposed in the receiving space;

a metallic shell enclosing at least partially said housing;

a pair of latch elements disposed in the housing, each of said latch element including a deflectable main arm extending into the receiving space with a bulged mating portion at a front end thereof;

a pair of resilient structures located outwardly beside the corresponding latch elements, respectively, a second connector including a mating part adapted to be inserted into the receiving space with in two opposite lateral sides a pair of notches adapted to receive the bulged mating portions of the corresponding latch elements during mating, respectively;

wherein when the mating part of the second connector is not inserted into the receiving space, the resilient structure is not activated and the latch element functions in a cantilevered manner while during mating, the resilient structure is activated to provide an additional support between the latch element and the shell to replace said cantilevered manner; wherein both said latch element and said resilient structure are metallic so as to form a conductive path from the latch element to the shell via said resilient structure when the resilient structure is activated and deformed.

13. The electrical connector as claimed in claim 12, wherein said resilient structure is located roughly adjacent to and behind the bulged mating portion of the corresponding latch element in a front-to-back direction.

* * * * *